United States Patent [19]

Dallimer et al.

[11] Patent Number: 4,973,197

[45] Date of Patent: Nov. 27, 1990

[54] SILOS AND METHODS OF BURYING SAME

[75] Inventors: David S. Dallimer, London, England; Giles M. Nixon, Toronto, Canada

[73] Assignee: LME Petroscope Limited, United Kingdom

[21] Appl. No.: 359,660

[22] PCT Filed: Nov. 20, 1987

[86] PCT No.: PCT/GB87/00829

§ 371 Date: Jun. 20, 1989

§ 102(e) Date: Jun. 20, 1989

[87] PCT Pub. No.: WO88/03975

PCT Pub. Date: Jun. 2, 1988

[30] Foreign Application Priority Data

Nov. 20, 1986 [GB] United Kingdom ..... 8627738

[51] Int. Cl.[5] ..... E02D 23/14

[52] U.S. Cl. ..... 405/133; 405/233; 405/244

[58] Field of Search ..... 405/133, 232, 234, 240, 405/242, 243, 154, 233, 229, 244; 52/512

[56] References Cited

U.S. PATENT DOCUMENTS

| | | | |
|---|---|---|---|
| 2,065,003 | 12/1936 | Widugier | 405/133 |
| 3,293,865 | 12/1966 | Loofbourow et al. | 405/133 |
| 3,492,823 | 2/1970 | Lamberton | 405/133 |
| 4,107,930 | 8/1978 | Thieofe | 405/133 |
| 4,585,681 | 4/1986 | Kidera et al. | 405/234 X |
| 4,671,703 | 6/1987 | Schmidt | 405/154 X |

FOREIGN PATENT DOCUMENTS

| | | |
|---|---|---|
| 352971 | 4/1961 | Fed. Rep. of Germany . |
| 1222442 | 1/1962 | Fed. Rep. of Germany . |
| 2057709 | 6/1970 | France . |
| 2217969 | 2/1973 | France . |
| 692227 | 6/1953 | United Kingdom . |
| 260143 | 3/1988 | United Kingdom . |

*Primary Examiner*—Dennis L. Taylor
*Assistant Examiner*—Franco Deliguori
*Attorney, Agent, or Firm*—Fulbright & Jaworski

[57] ABSTRACT

A silo or like structure (16) adapted to be driven end first into the ground comprising an elongate body, wherein the body is enlarged at one end thereof, wherein the enlarged portion carries a cutter (28) directed axially away from the body so as to form an outsize hole for the body when the structure (16) is driven in, wherein ducts (210, 211, 212) are provided for conveying a fluid from a fluid source to the outside of the body behind the enlarged portion, and wherein the structure (16) includes a flexible sleeve (214) attached to the enlarged portion and adapted to cover the body in spaced relationship therefrom, the ducts (210, 211, 212) opening into the annular space defined between the body and the sleeve (214) when the sleeve (214) is in its covering position.

9 Claims, 2 Drawing Sheets

SILOS AND METHODS OF BURYING SAME

Figure 1:
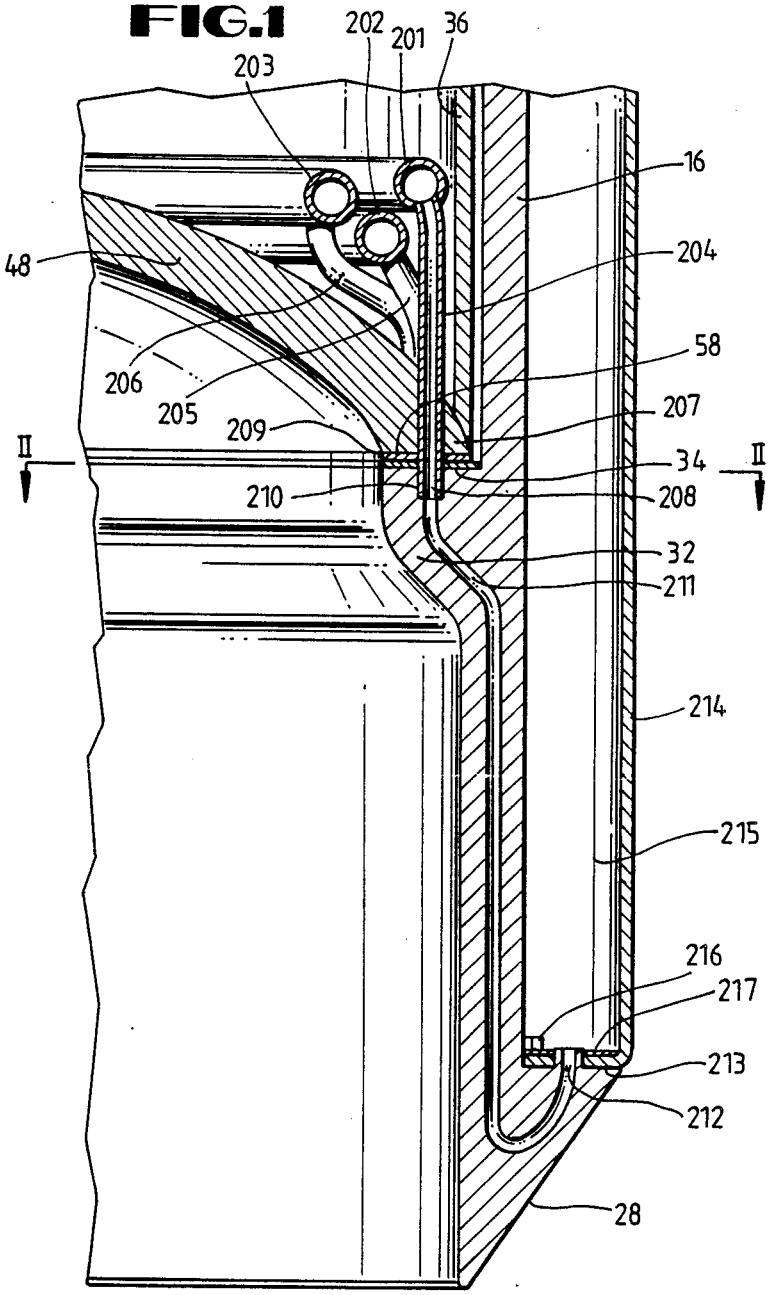

The present invention relates to silos and to methods of burying them, i.e. inserting them in the ground, both on dry land and under water.

By the term "silo" as used herein is meant any elongate structure, whether hollow or solid, open or closed, which is adapted to be driven in end first into the ground. Although preferably tubular and of steel, such a silo can be of any shape and of any material which can allow driving in of the silo into the ground either by hydraulic, mechanical or hydrostatic means. For example the silo can be square in cross-section, closed at its upper end and of concrete in the manner of a caisson. The silo can also take the form of a solid pile which has been provided at its lower end with a sharp point.

One of the main problems encountered during the driving in of silos into the ground is the friction caused by the movement of the silo walls through the soil. As the silo is driven deeper into the soil so the area of silo wall moving against the soil increases, and furthermore the pressure of the surrounding soil against the silo walls similarly increases with increasing depth of silo penetration. Thus regardless of the type of soil encountered by the silo, there is generally a limit to the depth of penetration achievable by a silo for a given force of silo drive.

One system for reducing this friction is described in our U.S. Pat. No. 4,744,698. In Pat. No. 4,744,698, the cutting end of the silo is enlarged around its opening so as to form an outsize cutting "shoe". The cross-section of the shoe is wedge-shaped and the sloping edge of the shoe extends beyond the line of the outside of the silo. By this means the hole cut by the cutting shoe is larger than the profile of the silo and thus an annular space is formed at least initially around the silo as it is driven in the soil, thereby reducing the amount and pressure of the surrounding soil in contact with the silo walls during insertion of the silo.

With many loose soils and with increasing depth of insertion, however, the annular space created by the shoe does not stay free of soil for long, and soil frequently falls into the space from the hole sides and friction again starts to increase.

It has now been found possible to reduce this infilling and resultant friction, and hence permit greater insertion depths for silos, by arranging for a fluid-inflated sleeve to occupy this annular space.

In accordance with the present invention there is provided a silo or like structure adapted to be inserted end first into the ground to a desired depth comprising an elongate body enlarged at one end, a cutter carried by the enlarged portion and directed axially away from the body so as to form an outsize hole for the body when the structure is inserted into the ground, a flexible sleeve attached to the periphery of the enlarged portion, and duct means opening into an annular space defined between the body and the sleeve for conveying a fluid from a fluid source to the adjacent enlarged portion, characterized in that the flexible sleeve is adapted to cover essentially the entire inserted length of the body in spaced relationship therefrom, and in that the sleeve is porous with respect to the said fluid.

The invention also provides a method of inserting a structure of the present invention into the ground comprising driving the structure downwardly whilst pumping a fluid from the source into the annular space between the body and the sleeve through the duct means.

Preferably, the enlarged portion is hollow and axially open and wherein the cutter takes the form of a circumferential cutting edge around the opening. Means can then be provided within the body for removing soil from the interior thereof. In one embodiment the removal means comprise at least one water jet and a slurry pump, whilst in another the removal means comprises a mechanical excavator. Desirably, the removal means is releasably attached to the body.

As will readily be appreciated by those skilled in the art, the rate of flow of the fluid into the annular space should be at least sufficient to ensure that the entire sleeve is completely inflated throughout the insertion of the silo, thereby helping to support the walls of the hole against collapse. The fluid flow also helps to keep the annular space free of soil.

In order to positively prop up the walls of the silo hole and maintain this annular space substantially free of soil, the silo of the present invention includes a flexible sleeve attached to the enlarged portion and is adapted to cover the body in spaced relationship therefrom, the duct means opening into the annular space defined between the body and the sleeve when the sleeve is in its covering position. Desirably the sleeve is porous with respect to the said fluid so that at least some of the fluid within the annular space can migrate to the outer surface of the sleeve and thereby help to reduce the friction of the soil against the sleeve itself as the sleeve and silo move into the soil. This migration of fluid should, of course, be made up for by a slightly increased fluid flow into the annular space.

Conveniently, the sleeve is formed of a porous fabric. In order to withstand the abrasion of the soil during insertion, it is preferred that the sleeve be made of a so-called "geo-textile" fabric. Such fabrics are .well known to soil engineers.

Since the sleeve covers the silo over essentially its entire inserted length, either substantially the entire silo should be covered right from the commencement of its insertion or else, more preferably, the sleeve should be arranged to unfold progressively along the silo length as insertion proceeds. Conveniently, in the latter case, means are provided for holding the sleeve in a concertina manner and for allowing the sleeve to be pulled out during driving in of the structure.

Being supported away from the silo body predominantly by annular fluid pressure alone, the sleeve remote from its ends may have a tendency to fall back against the silo body under the effect of local soil pressure, caused for example by displaced rocks falling against the sleeve. One way of countering such localized collapse of the sleeve is to maintain the sleeve under tension throughout the insertion process. Where the sleeve is gradually unfolded from, say, a concertina, this can be achieved by feeding the sleeve over a plurality of friction rollers, by arranging for successive sections of the sleeve to be held by shearable connectors, or by providing a plurality of releasing gripping arms on the silo. A second way is to incorporate into the silo, at periodic intervals along its length, a number of supports such as in the form of rigid circumferential bands, for example of plastics material, positioned between the sleeve and the silo in order to hold the sleeve away from the silo. These bands can be attached either to the outer surface of the silo or to the inner surface of the sleeve.

The fluid to be pumped into the annular space can comprise a wide range of different substances depending on whether the silo is to be used on dry land or under water, on the nature of the soil into which the silo is to be inserted, on the materials locally available, and on the nature of the sleeve used. The fluid can either be admitted gradually into the annulus to act essentially as a stagnant pool, or else can be positively circulated through the annulus under pressure. In the former case the upper end of the annulus is generally open, whilst in the latter case it is closed with outlets near the top to take the fluid back inside the silo ready to be pumped round again through the annulus.

In order to achieve a good "propping" effect on the soil of the hole walls, the fluid should be under relatively high pressure and/or should be of a relatively high density. Where for example the silo is to be inserted under water, the fluid can suitably be a mixture of compressed air and the ambient water, the air being at a pressure substantially higher than the local hydrostatic head at the maximum depth of insertion of the silo. On dry land, compressed air alone can be used. When using air the porous sleeve allows some of the air to migrate to the surface of the sleeve and lubricate the same during insertion.

In many situations the fluid of choice will be an aqueous slurry of a high density inert material such as a clay. A particularly useful clay is bentonite. The main advantage of using a liquid is that its own hydrostatic head increases with increasing depth of insertion of the silo and counteracts the increase with depth of the soil pressure against the silo. When under water, there can also be complete compensation using a liquid for the increasing hydrostatic head with depth of the ambient water. In this case the sleeve is porous either to the slurry as a whole or to just the water therein.

Generally, it is desired to complete the insertion of the silo after driving in to the required depth by anchoring it to the surrounding soil. Although this can be done by filling in, or allowing to be filled in, the annular space created around the silo during insertion, it is preferred to pump a hydraulic cement/water slurry from a slurry source into the annular space between the body and the sleeve through the duct means after the structure has been driven in to a desired depth.

If the silo is to act as a holder or refuge for such things as oil well heads, then the hollow, open form of silo is generally used, the removal of the ingressed soil either taking place during insertion — which is preferred — or after anchoring of the silo. Generally accurate vertical alignment of such silos is required, and this can be achieved by any suitable means. When inserting a silo under water a preferred means for achieving the vertical alignment is the template structure described in our U.S. Pat. No. 4,744,698. Other features, such as the buoyancy means, of the under water apparatus described in our U.S. Pat. No. 4,744,698 can also be used with the silos of the present invention.

One embodiment of the present invention will now be described, by way of example, with reference to the accompanying drawings and with reference to the specification of our U.S. Pat. No. 4,744,698

Figure 2:
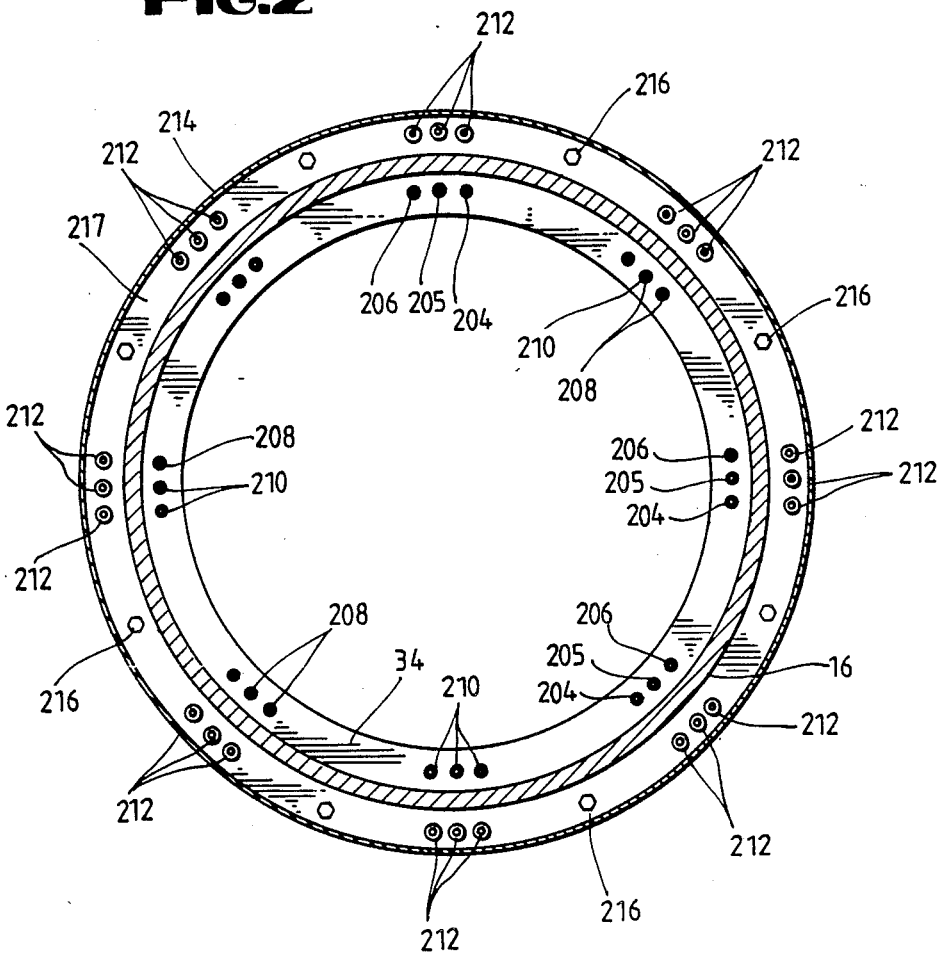

In the drawings accompanying this application:

FIG. 1 is a sectional elevational view of the lower portion of a rotationally symmetrical silo and excavation module combination of the type described and illustrated in our U.S. Pat. No. 4,744,698, but modified in accordance with the present invention for use in underwater excavation, and FIG. 2 is a sectional plan view of the silo of FIG. 1 taken on the line II—II, with the excavation module removed.

The reference numerals below 200 refer to the reference numerals used in the drawings of our copending U.S. Pat. No. 4,744,698 whilst those above 200 refer to the drawings accompanying this application.

For the purposes of the present invention, the construction and operation of the template/silo/ excavation module described and illustrated in U.S. Pat. No. 4,744,698 are as set out in U.S. Pat. No. 4,744,698, particularly with reference to FIG. 4 thereof, except that the lower ends of silo and excavation module are modified by the addition of duct means and a flexible sleeve, and that the excavation step is simultaneously carried out with the pumping of a fluid into the annulus formed between the sleeve and the body of the silo.

Referring first to FIG. 4 of U.S. Pat. No. 4,744,698 it will be noted that the excavation module 36 is separable from the silo 16. When excavating, the module 36 is located within the silo 16 and exerts a downward force thereon by means of the engagement of the support rim 58 of the module in the shoulder 34 of the silo's thrust ring 32. When the duct means of the present invention, is incorporated into the apparatus described in U.S. Pat. No. 4,744,698, therefore, it will take the form of two duct systems — one in the excavation module and one in the silo itself — fluidly linked across the support rim/shoulder junction.

Referring now to FIGS. 1 and 2 of the drawing accompanying this application, the illustrated part of the duct system within the excavation module 36 consists of three ring-shaped fluid manifolds 201, 202 and 203 for, respectively, air, water and an aqueous slurry of either bentonite or cement running around the periphery of the transverse bulkhead 48. Each manifold has a plurality of transfer tubes 204, 205 and 206, respectively, connected thereto to distribute the fluids around the module 36, each transfer tube leading into a respective drilling 207 in the transverse bulkhead 48 before exiting the excavation module at its associated transfer port 208. The module transfer ports 208 are regularly spaced circumferentially around the support rim 58 and project downwardly therefrom through the sealing gasket 209 between the module and the silo to connect with corresponding silo transfer ports 210 located in the shoulder 34.

The manifolds 201, 202 and 203 distribute their respective fluids evenly to all of their respective module transfer ports 208, each being supplied at pressure from a corresponding fluid source (not shown). These fluid sources could lie within the excavation module itself, but are generally located on the excavation module supply ship. Suitable fluid control means (not shown) including non-return valves (not shown) are generally provided to regulate the flow of the fluids out of their respective module transfer ports 208.

The duct system within the silo 16 consists of a plurality of silo transfer ports 210, silo drillings 211 into which the ports 210 lead, and silo duct outlets 212 at the ends of the drillings 211. The silo transfer ports 210 are spaced around the shoulder 34 and recessed therein so as to mate with the corresponding projecting module transfer ports 208. The silo drillings 211 run axially through the thrust ring 32 and down inside the lower wall of the silo 16 into the cutting shoe 28. Inside the cutting shoe 28 the silo drillings turn through 180° to exit the shoe upwardly at their associated outlets 212. These outlets 212 are correspondingly spaced around the cutting shoe 28 and project in the form of nozzles upwardly beyond the plane of the horizontal return face 213 of the shoe 28.

The outlets 212 are arranged approximately midway between the outer edge of the main body of the silo 16 and the outer edge of the shoe 28. The outlets 212 are, like the rest of the duct means, grouped in threes for the air, water and slurry, respectively, in order to keep the different fluids separate. For example, the air should be kept dry.

Connected to the return face 213 of the shoe 28 is the flexible sleeve 214 formed of a fluid permeable geo-textile fabric. The main body of the sleeve 214 runs concentrically along the length of the silo 16 but the lower end thereof is turned inwardly through 90° so as to be attached by bolts 216 through clamping ring 217 to the shoe 28. The annular space 215 lying between the outer surface of the silo 16 and the inner surface of the sleeve 214 extends from behind the cutting shoes 28 upwardly to cover essentially all of the silo 16 that is inserted at that point in time into the sea bed. Towards the upper end of the silo fluid inlets (not shown) can be provided if it is desired to circulate one of the fluids through the annular space 215.

When the silo 16 is being inserted into the sea bed, the excavation module 36 presses downwardly on the thrust ring 32 of the silo whilst the excavation apparatus (not shown) of the module removes the soil from the area within the compass of the cutting shoe 28. Simultaneously with this excavation operation, the fluid of choice is passed under pressure from its source (not shown) into the corresponding manifold 201, 202 or 203 for distribution via the duct means in the module and the silo around the entire periphery of the silo 16. The fluid enters the annular space 215 via its set of outlet nozzles 212 and fills, or is recirculated through, substantially the entire length thereof which lies beneath the sea bed. The pressure of the fluid within the annular space 215 maintains the sleeve 214 in spaced relation to the silo 16, and because of the porous nature of the sleeve a small proportion of the fluid passes through the sleeve 214 in order to lubricate the outer surface thereof and reduce soil friction thereagainst.

The fluid control system (not shown) regulates the flow of the fluid into the annular space 215 in accordance with the rate of penetration of the cutting shoe 28 and the rate of permeation of the fluid through the sleeve 214. It also enables two or more of the fluids, such as air and water, to be fed into the space simultaneously.

It will be appreciated by those skilled in the art that the number and orientation of the outlet nozzles 212 can be varied considerably depending on the size and type of silo used, provided that they are positioned behind the cutting shoe 28 so as to eject the fluid into the annular space 215. Furthermore, the construction and disposition of the duct means which conveys such fluid from its source to its outlets 212 can be varied depending on the type of silo used. It is always desirable to keep the paths for the three fluids separate, but the cement slurry can be fed through the water, rather than bentonite slurry, duct means if that is found to be preferable for a particular arrangement.

Once the silo 16 has been inserted to the required depth using, say, a bentonite slurry as the annular space 215 filling fluid, the fluid control system (not shown) can be switched to pump a hydraulic cement/water slurry into the space instead of bentonite. After complete filling of this space with the cement slurry, the control system stops the cement slurry flow and closes all of the one-way valves in order to prevent back flow thereof out of the annular space 215. The excavation module 36 can then be withdrawn from the inserted silo 16 and the cement slurry around it allowed to harden. A firmly inserted silo is thereby installed to act as a sub sea-holder or well head refuge.

We claim:

1. A silo or like structure adapted to be inserted end first into the ground to a desired depth comprising an elongate body enlarged at one end, a cutter carried by the enlarged end and directed axially away from the body so as to form an outside hole for the body when the structure is inserted into the ground, a flexible sleeve attached to the periphery of the enlarged end, and duct means opening into an annular space defined between the body and the sleeve for conveying a fluid from a fluid source into said annular space characterized in that the flexible sleeve is adapted to cover essentially the entire inserted length of the body in spaced relationship therefrom, and in that the sleeve is porous with respect to the said fluid, whereby the pressure of said fluid conveyed in said annular space maintains the sleeve in said spaced relationship and the porosity of the sleeve permits a small proportion of said fluid to pass through the sleeve in order to lubricate the outer surface thereof and reduce soil friction thereagainst as the structure is inserted into the ground.

2. A structure as claimed in claim 1 wherein the enlarged end is hollow and axially open and wherein the cutter takes the form of a circumferential cutting edge around the opening of said enlarged end.

3. A structure as claimed in claim 1 wherein the sleeve is formed of a porous fabric.

4. A structure as claimed in claim 1 including at least one sleeve support for maintaining the sleeve in spaced relationship to the body.

5. A structure as claimed in claim 1 which is adapted to be inserted into an underwater sea bed.

6. A method of inserting a silo or like structure end first into the ground to a desired depth which structure comprises an elongate body enlarged at one end, a cutter carried by the enlarged end and directed axially away from the body so as to form an outsize hole for the body when the structure is inserted into the ground, a flexible sleeve attached to the periphery of the enlarged end, and duct means opening into an annular space defined between the body and the sleeve for conveying a fluid from a fluid source to the annular space, wherein the flexible sleeve is adapted to cover essentially the entire inserted length of the body in space relationship therefrom, and wherein the sleeve is porous with respect to said fluid, the method comprising driving the structure downwardly whilst pumping a fluid from the source into the annular space between the body and the sleeve through the duct means; maintaining the sleeve in the spaced relationship with respect to the body; and permitting a small proportion of the fluid to pass through the porous sleeve in order to lubricate the outer surface thereof and reduce friction thereagainst.

7. A method as claimed in claim 6 wherein the fluid is an air/water mixture.

8. A method as claimed in claim 6 wherein the fluid is an aqueous slurry of bentonite.

9. A method as claimed in any one of claims 6, 7 or 8 including the steps of pumping a hydraulic cement/water slurry from a slurry source into the annular space between the body and the sleeve through the duct means after the structure has been driven in to a desired depth, and allowing the slurry to set around the structure.

* * * * *